US005626289A

United States Patent [19]

Demers, Jr. et al.

[11] Patent Number: 5,626,289

[45] Date of Patent: May 6, 1997

[54] PRECAST CONCRETE RAILROAD CROSSING AND METHOD FOR MAKING

[76] Inventors: Albert P. Demers, Jr., 4087 Colts Foot La., Lake Oswego, Oreg. 97035; David Brandt, 6345 Caufield La., Stayton, Oreg. 97383

[21] Appl. No.: 519,110

[22] Filed: Aug. 25, 1995

[51] Int. Cl.[6] ..... E01B 2/00

[52] U.S. Cl. ..... 238/8; 404/40

[58] Field of Search ..... 238/3, 5, 6, 7, 238/8, 10 R, 10 C; 404/34, 40, 44, 64

[56] References Cited

U.S. PATENT DOCUMENTS

| | | | |
|---|---|---|---|
| 1,912,429 | 6/1933 | Burgess | 404/40 |
| 3,469,783 | 9/1969 | Uralli et al. | 238/8 |
| 3,938,776 | 2/1976 | Frazier | 249/114 |
| 4,236,670 | 12/1980 | Limmergard et al. | 238/8 |
| 4,641,779 | 2/1987 | O'Brien et al. | 238/8 |
| 4,860,952 | 8/1989 | Schmidt | 238/8 |
| 4,899,933 | 2/1990 | Martin | 238/8 |
| 5,181,657 | 1/1993 | Davis | 238/8 |

FOREIGN PATENT DOCUMENTS

| | | | |
|---|---|---|---|
| 8606428 | 11/1986 | WIPO | 238/8 |

*Primary Examiner*—S. Joseph Morano

*Attorney, Agent, or Firm*—Marger, Johnson, McCollom & Stolowitz

[57] ABSTRACT

Precast concrete panels are laid end to end on the field sides and between the rails of a track to form a grade crossing. In one embodiment, the panels are screwed to wooden rails upon which they rest. In another embodiment, straps are used to bolt the ends of adjacent panels together to form an integrated unit of large size and mass which is resistant to movement. In making the panel, the top surface of the precast concrete panel is cast against the bottom surface of a mold having an insert therein which forms recesses on the top and end surfaces of each panel into which the strap is received to bolt the panels together.

20 Claims, 5 Drawing Sheets

PRECAST CONCRETE RAILROAD CROSSING AND METHOD FOR MAKING

BACKGROUND OF THE INVENTION

1. Field of the Invention

The present invention relates generally to railroad crossings having precast concrete panels and methods for making such crossings and more particularly to such crossings which include ties that support both railroad tracks and the panels.

2. Description of the Related Art

When a roadway crosses railroad tracks, a crossing must be constructed to permit traffic to pass over the tracks as smoothly as possible. Typically the top surfaces of each of the tracks are in substantially the same plane as the roadway on either side of the tracks. The crossing comprises material which is placed on either side and between the tracks to present a surface generally planar with the surface of the roadway and the top surfaces of the tracks.

Timber, asphalt, poured concrete and precast concrete are examples of prior-art materials which have been used to construct railroad crossings.

Two types of prior art precast concrete crossings include: (a) precast structures which are received under the railroad track in the crossing and which substitute for the railroad ties that support the track on either side of the crossing; and (b) precast structures which are supported on ties in the crossing adjacent railroad track which is also supported on the ties.

One example of the latter type of precast concrete crossing is disclosed in U.S. Pat. No. 5,181,657 to Davis for a composite rubber/concrete railroad grade crossing system. In Davis, substantially rectangular precast panels have a metal corner portion, made of angle iron, cast into the panel around the upper perimeter thereof. Elastomeric pad units abut either side of each rail with a plurality of central precast concrete panels laid end to end in the center and narrower precast concrete panels laid end to end on the outer sides of each track. The panels thus hold the elastomeric portion in place and are in turn restrained from longitudinal movement along the tracks by brackets which are bolted to the ties and which abut the panels at each end of the crossing.

The metal corner portions are provided to prevent the concrete corners from crumbling as a result of traffic passing thereover. In some prior art installations using similar panels, the metal corner portions on adjacent panels are welded together to prevent independent movement of separate panels.

Precast panels for use in grade crossings such as those shown in the Davis patent are created using a generally rectangular mold. A rectangular angle iron frame is placed on an upper portion of the mold. Thereafter concrete is placed in the mold to the level of the top surface of the frame thereby casting the metal frame into the upper surface of the panel.

Problems exist with using panels having metal corner portions such as those disclosed in the Davis Patent. Whether welded together or not, the metal creates a conductor capable of shunting currents between the rails which can create signalization malfunctions. Such prior art panels include opposing metal corner portions which are each within a few inches of an adjacent rail. In the presence of salt and water, especially in freezing temperatures, a conductive path between the rails is easily set up whether or not the corner portions are welded to one another.

The welds are also problematic when maintenance is required on the railroad bed in the crossing. This requires that the panels be removed, which in turn requires breaking the welds on any of the panels that are welded together. After maintenance of the bed, the panels are returned to the crossing and rewelded.

In some prior art crossings, panels like those shown in the Davis patent were both welded together and screwed, via bores through the panels, to wood ties which support the panels. This further restrained panel movement but did not alleviate problems caused by the metal corner portions. In addition, screwing into the wooden ties deteriorates them.

It would be desirable to provide a precast concrete panel for use in a grade crossing on a roadway which overcomes problems associated with prior art panels.

It would also be desirable to provide such a panel which is highly resistant to deterioration caused by freezing.

It would also be desirable to provide such a panel that will withstand heavy vehicle and rail traffic.

It would also be desirable to provide such a panel which reduces signalization problems.

It would also be desirable to provide such a panel with increased durability.

It would also be desirable to provide such a panel which overcomes problems associated with using metal corner portions as in the prior art panels.

It would also be desirable to provide such a panel which could be secured in position without welding the panels to one another or screwing the panels to the railroad ties supporting the track.

It would also be desirable to provide such a panel which can be easily removed and replaced for maintenance to the rail bed beneath the crossing.

It would also be desirable to provide a method for making such a panel.

SUMMARY OF THE INVENTION

In one aspect the present invention comprises a panel assembly for use in a grade crossing on a roadway intersected by a pair of railroad tracks supported on ties. A precast concrete panel has an upper surface which is substantially planar with the upper surface of the tracks when the panel is supported on the ties between the tracks. A recess formed on the upper surface of the panel also communicates with an end surface of the panel. The end surface extends substantially between the tracks when the panel is supported on the ties between the tracks. A threaded bore communicates with the upper panel surface and is received in the recess. In another aspect of the invention, a pair of precast concrete panels are laid end to end between the rails on the ties. A strap is received in both recesses in adjacent panels and has a first end secured to one of the panels and a second end secured to the other panel.

The invention also contemplates a method of making such a grade crossing by placing wet concrete into a substantially rectangular mold having substantially upright sides and ends and a bottom surface. So doing forms a substantially rectangular concrete panel having a top surface formed against the bottom surface of the mold. A plurality of such panels are formed and laid end to end with the panel bottom surfaces on the ties. In one aspect, such panels are bolted to the ties and in another the ties are connected to one another using the strap.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Figure 1:
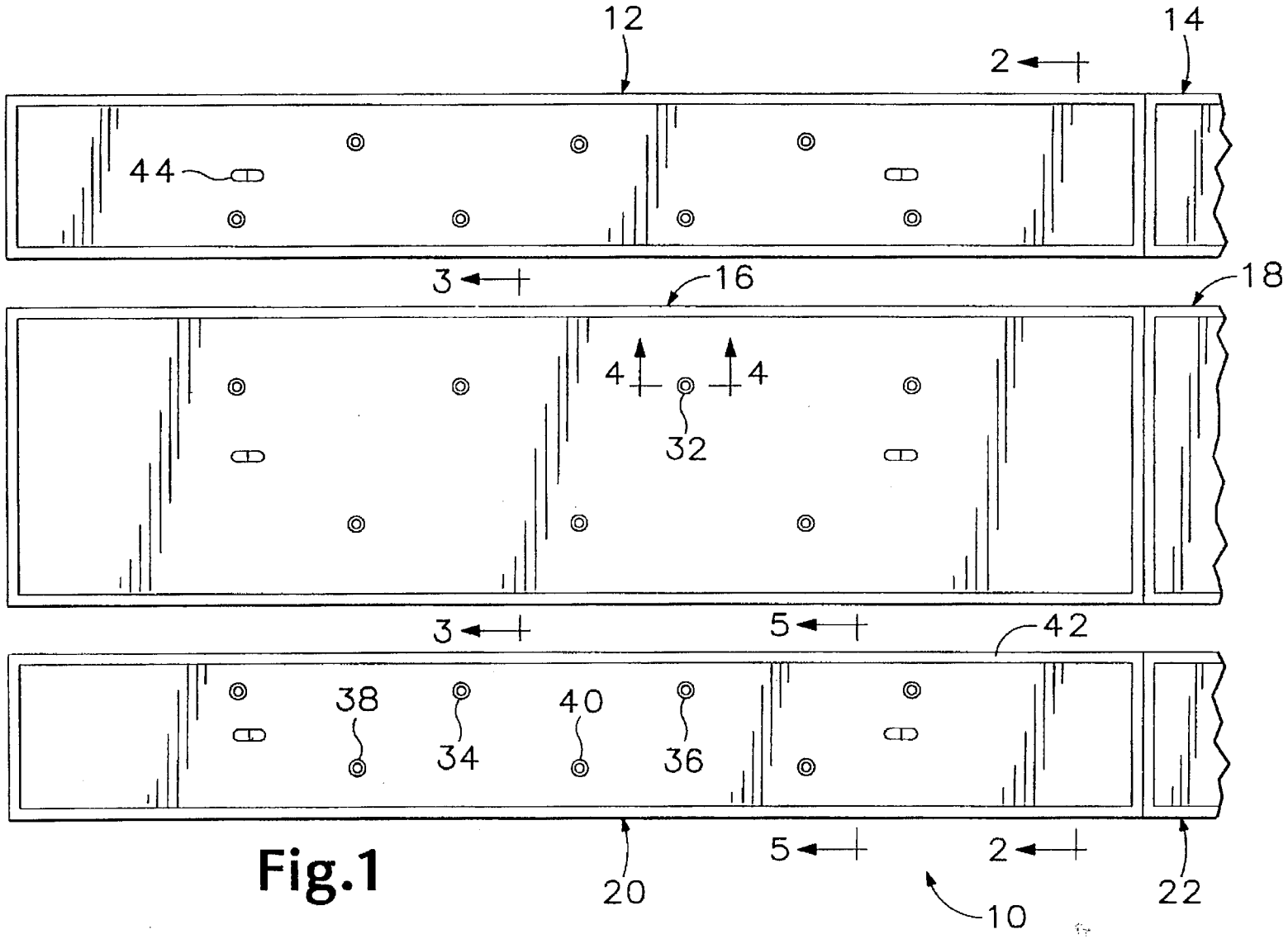
FIG. 1 is a top plan view of a portion of a railroad crossing constructed in accordance with a first embodiment of the invention with the track and related structure omitted.
Figure 2:
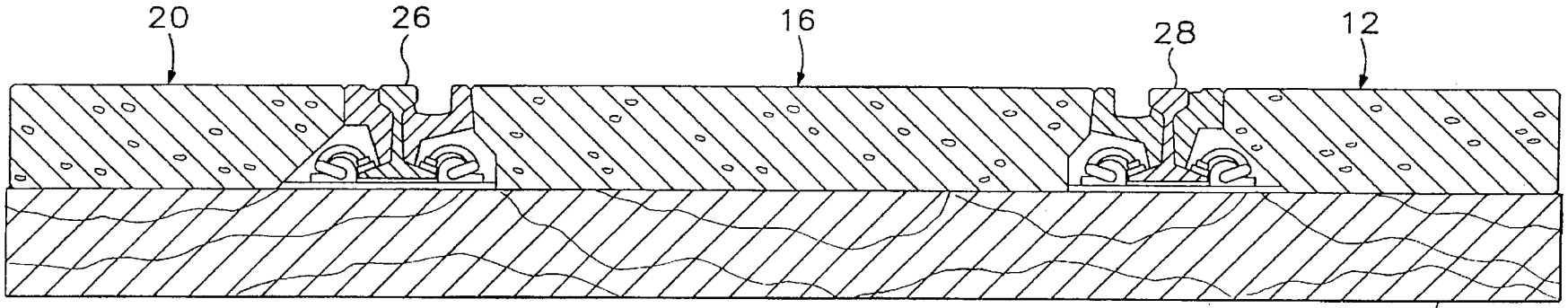
FIG. 2 is an enlarged sectional view taken along line 2—2 in FIG. 1 and including railroad tracks, ties, and related structure.

Turning now to FIGS. 1–5A, indicated generally at 10 is a portion of a crossing constructed in accordance with the present invention. Included therein are precast concrete panels 12, 14, 16, 18, 20, 22. In FIG. 2, crossing 10 is depicted installed on regularly spaced wooden ties, one of which is tie 24, which support a pair of railroad rails 26, 28 thereon.

In a preferred embodiment of the invention, each of the panels is 8 feet long with central or gauge panels 16, 18 each being 49 inches wide and each of the field or side panels 12, 14, 20, 22 each being 20⅛ inches wide. Panels 12, 20 are substantially identical to one another and are positioned symmetrically to form the crossing of the present invention as are all of the other filed panels, like panels, 14, 22. Also, panels 12, 14 are substantially identical to one another and are laid end to end with the endmost concrete surface of each panel substantially flushly abutting the other. In a like manner, panels 16, 18 are substantially identical and abut one another as are panels 20, 22. The panels each have endmost surfaces which are substantially vertical and planar. In FIG. 1, one of the endmost surfaces of panel 12 substantially flushly abuts one of the endmost surfaces on adjacent panel 14 as do adjacent endmost surfaces on panels 16, 18 and on panels 20, 22.

Figure 4:
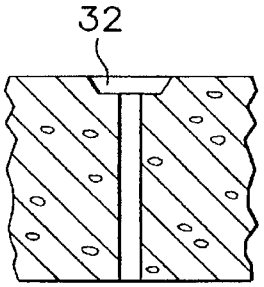
FIG. 4 is an enlarged partial view taken along lines 4—4 in FIG. 1.

A plurality of bores, like bores 30, 32, 34, 36, 38, 40 are formed through each of the panels as is best viewed in FIG. 4. The bores are spaced from one another to permit them to be lined up substantially on the center line of a tie beneath the panel. For example, the distance between bores 34, 36 is equal to the distance between the center lines of adjacent ties in one standard form of tie spacing. Further, the distance between bores 38, 40 is equal to the distance between bores 34, 36. Thus, one or the other of the lines or bores in each panel can be used to screw the panel onto the ties, like tie 24, which support it.

A one-half inch 45 degree chamfer, like chamfer 42 on panel 20 and chamfer 43 on panel 22, is formed around the upper perimeter of each of the panels. Each panel includes two lifting hooks, like lifting hook 44 in panel 12, cast therein to facilitate handling of the panels prior to and during installation.

Figure 3:
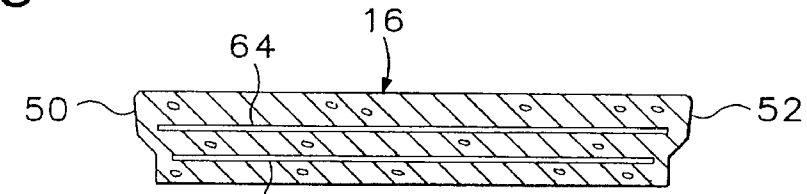
FIG. 3 is an enlarged cross-sectional view taken along lines 3—3 in FIG. 1.
Figure 5A:
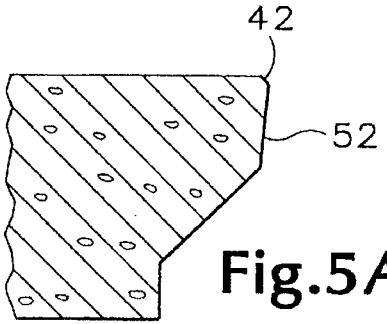
FIG. 5A is an enlarged partial view of a portion of the structure depicted in FIG. 5.
Figure 5:
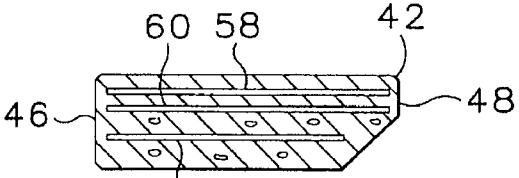
FIG. 5 is an enlarged view taken along lines 5—5 in FIG. 1.
Figure 2A:
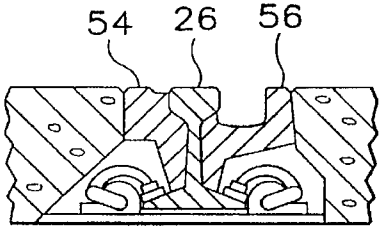
FIG. 2A is an enlarged partial view of a portion of the structure depicted in FIG. 2.

Each of the panels include what is referred to herein as a sidemost surface, like surfaces 46, 48 on panel 20 in FIG. 5 and surfaces 50, 52 on panel 16 in FIG. 3. Surfaces 48, 50 each abut against a commercially available, elongate elastomeric filler 54, 56 as best viewed in FIG. 2A. It should be appreciated that the crossing of the present invention can be implemented without any filler, like fillers 54, 56. Other commercially available filler, such as asphalt, can also be used to seal between the rails and the panels which prevents moisture from entering the space between the panels and rails.

Each of the panels, like panel 20 in FIG. 5 and panel 16 in FIG. 3, include wire mesh reinforcing layers, like layers 58, 60, 62 in panel 20 and layers 64, 66 in panel 16, cast therein. Each layer comprises horizontal and parallel wires which, in the present embodiment of the invention, form 3 inch by 4 inch squares and which are joined at their intersections. As will later be explained in more detail, when the panels are east, insulating spacers separate the reinforcing wire mesh layers from each other to limit the conduction paths for any currents which may arise in one of the mesh layers.

Figure 6:
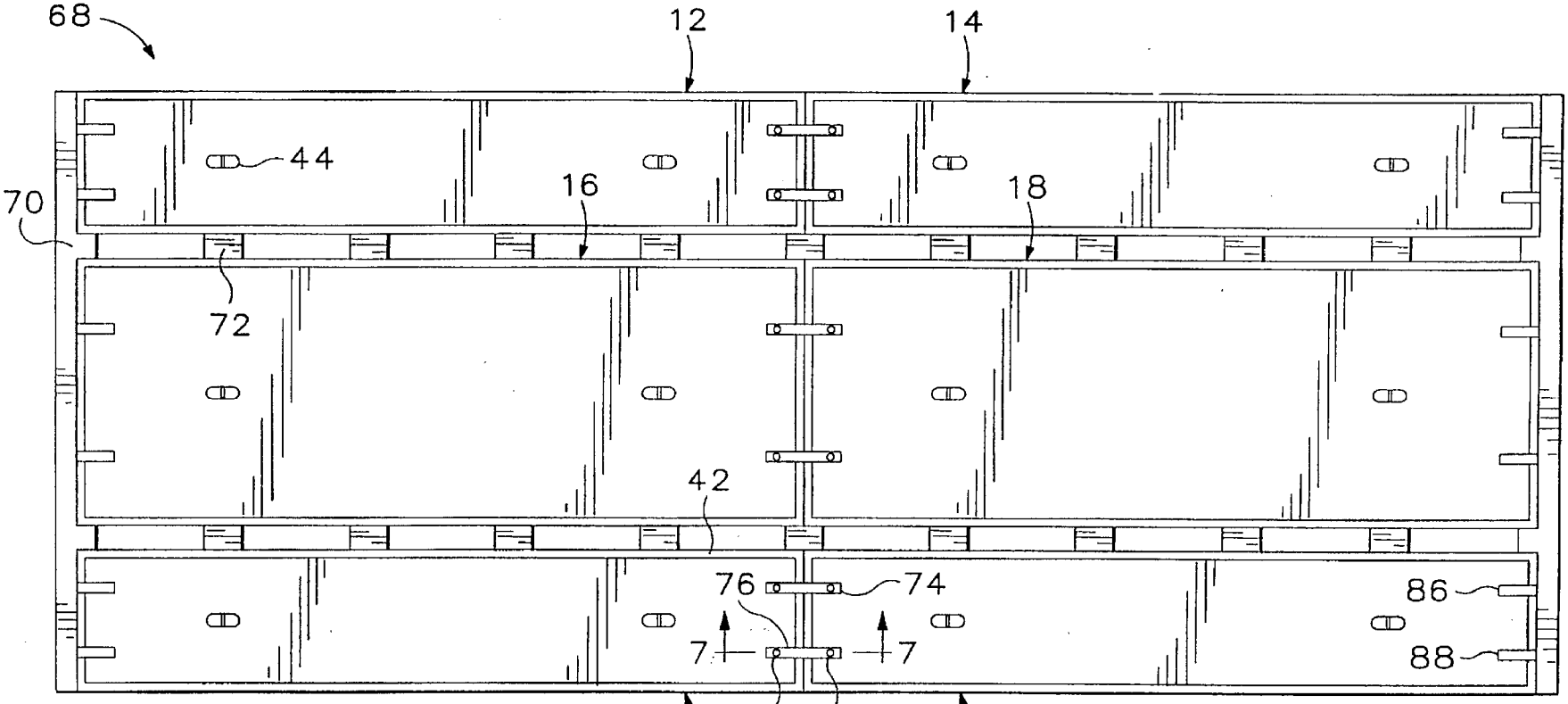
FIG. 6 is a top plan view of a portion of a railroad crossing constructed in accordance with a second embodiment of the invention and depicting concrete ties with the track and related structure omitted.

Indicated generally at 68 in FIG. 6 is a portion of a second embodiment of a crossing constructed in accordance with the present invention. Structure corresponding to that previously identified in the embodiment of FIGS. 1–5A contains the same numeral in FIG. 6. In the embodiment of FIG. 6, the ties, like ties 70, 72, are formed from precast concrete and are known in the art. A cross section taken along the longitudinal axis of one of the ties, like tie 72 in crossing 68, is substantially identical to the view of FIG. 2. Some precast ties, however, have a slightly elevated portion on an upper surface thereof where each of the rails, like rails 26, 28 in FIG. 2, are supported. Also known in the art, elastomeric pads may be placed on the upper surface of each concrete tie prior to positioning the rails and panels thereon to provide a shock absorbing layer.

Another difference between crossing 10 and the crossing of FIG. 6 is the absence of vertical bores, like bores 30, 32, 34, in the panels of the embodiment of FIG. 6. It can be appreciated that timber screws cannot be used to screw the panels in crossing 68 to the concrete ties, like ties 70, 72, upon which the panels rest. Instead of affixing the panels to the ties, the panels in crossing 68 are secured to one another where the ends of each panel abut. For example, panels 20, 22 are secured by elongate straps 74, 76. Each strap is secured to one of the panels via a ¾×3" bolt, like bolts 78, 80 on strap 76 as best viewed in FIGS. 7. Each of the bolts includes a shank, like shank 81 on bolt 80.

Strap 76 is received in a pair of recesses 82, 84 formed on the upper and end surfaces of concrete panels 20, 22, respectively. Each of the recesses includes chamfered upper portions, chamfers 85*a*, 85*b* in recess 84 as viewed in FIG. 8. As can be seen in FIG. 6, two recesses are east into each end of each of the concrete panels, like recesses 86, 80 are cast into one end of panel 22 with recess 84 (in FIG. 7) and a corresponding recess beneath strap 74 (not visible) being east in the other end. Recesses 86, 88 are visible because they are cast into a panel end on one side of the crossing. Recesses 86, 88 accordingly do not have a strap received therein.

Returning again to FIGS. 7 and 8, strap 76 includes a steel strap 90 which is substantially coated with a substantially nonconductive elastomer 92. Openings in elastomer 92 are formed to accommodate the head of each of bolts 78, 80 as shown. In the present embodiment of the invention strap 76 is approximately 14 inches long with steel strap 90 being formed from ⅜" steel.

Figure 8:
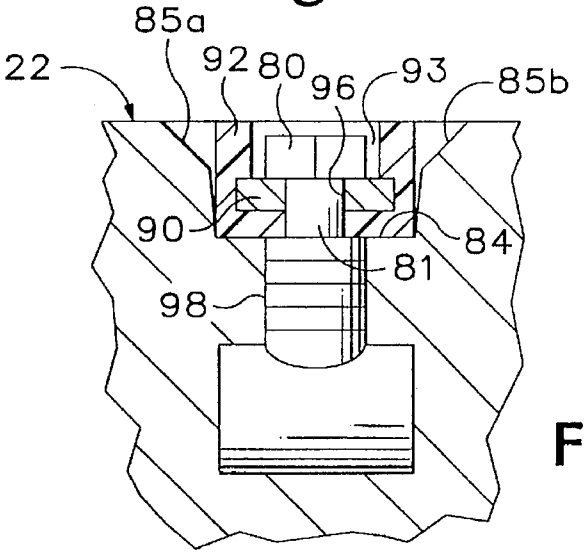
FIG. 8 is a view taken along line 8—8 in FIG. 7.

A pair of elongate slots 94, 96 are formed through either end of steel strap 90. As can be seen in FIG. 8, the slots, like slot 96, have a width greater than shank diameter of bolt 80 but narrower than the head thereof.

Figure 7:
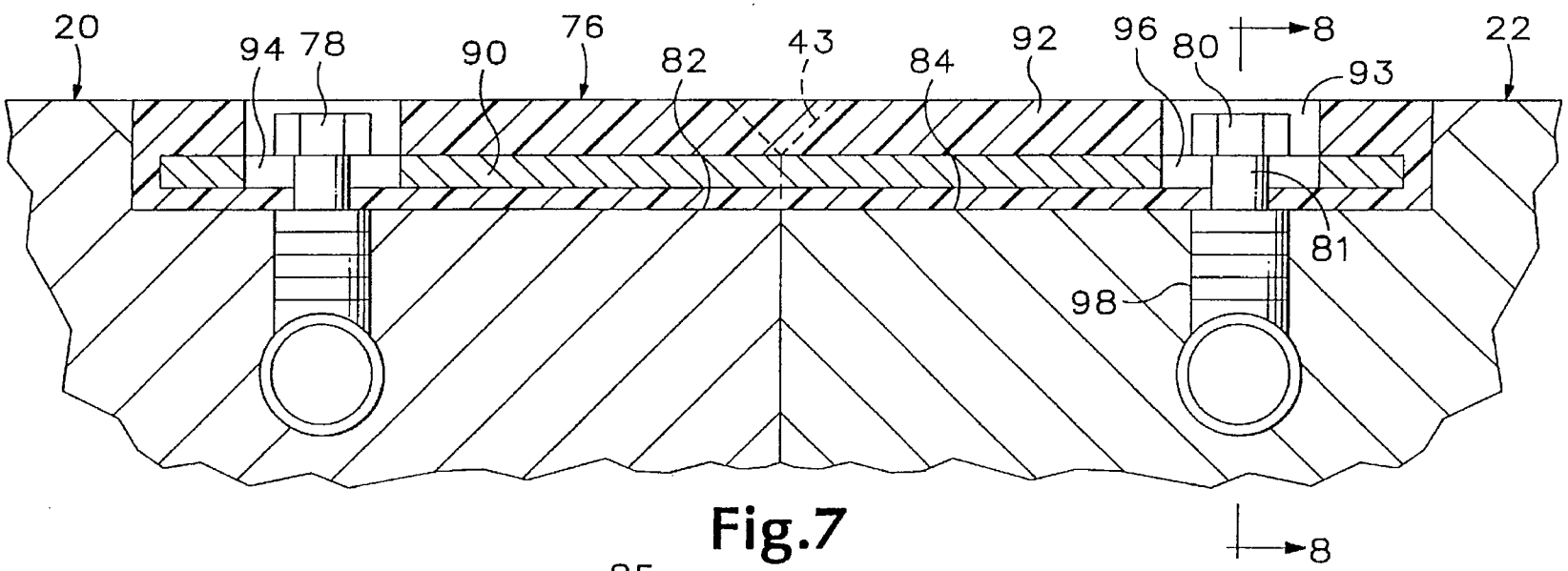
FIG. 7 is an enlarged partial view taken along lines 7—7 in FIG. 6.

In FIGS. 7 and 8 threaded shank 81 is threadably engaged with a commercially available base anchor 98 which is cast into panel 22 when the same is made as will later be explained in more detail. Anchor 98 includes a threaded bore into which shank 81 is threadably received for securing one end of strap 76 as shown in the drawing. Bolt 78 as are each of the other bolts in the panels are received in substantially identical base anchors cast in the panels.

Figure 9:
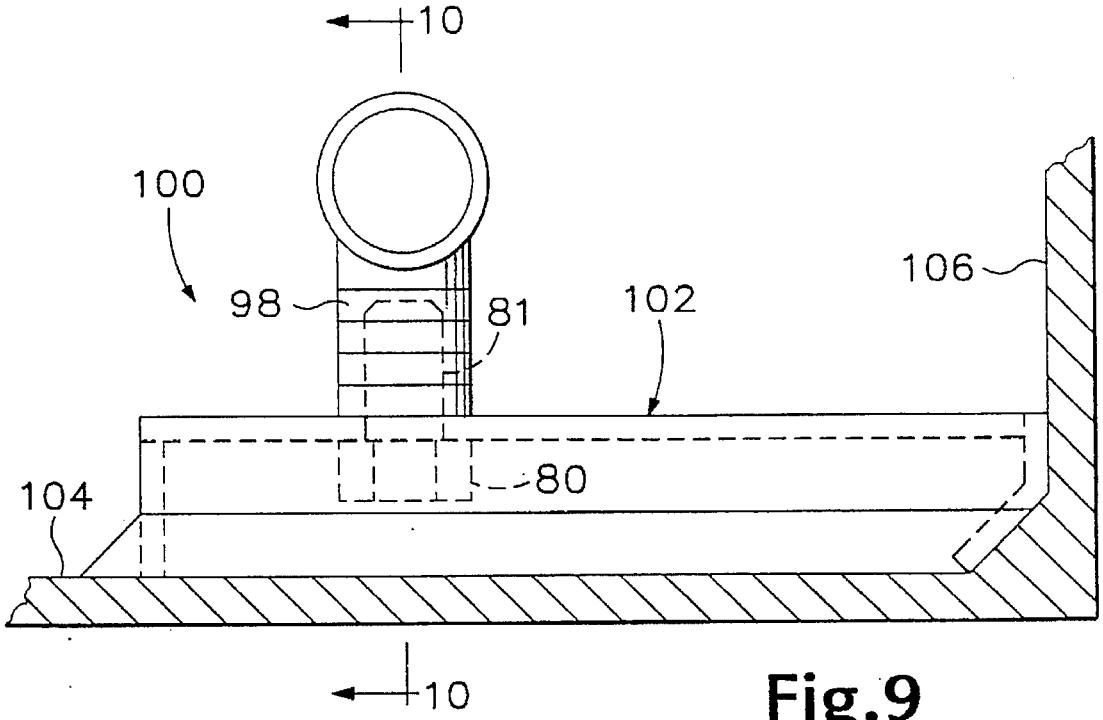
FIG. 9 is an enlarged view of a portion of a mold used to cast one of the panels in the crossing of FIG. 6 including a base anchor which is cast in the panel.
Figure 10:
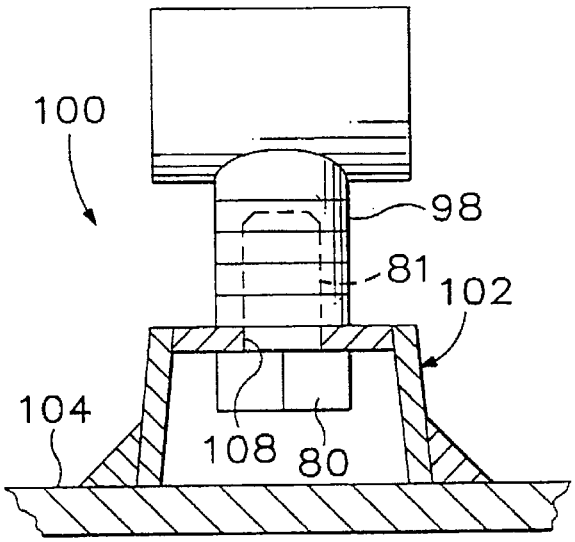
FIG. 10 is a view taken along line 10—10 in FIG. 9.

Turning now to FIGS. 9 and 10, indicated generally at 100 is a portion of a mold used to cast one of the panels in the crossing of FIG. 6. The mold is formed with steel plates and includes an insert 102, also formed of steel plate, mounted on a bottom surface 104 and a side surface 106 of the mold. Three other side surfaces (not shown) form a generally rectangular mold for casting the panels. Insert 102 forms a recess, like recesses 82, 84, in FIG. 7, when wet concrete is placed into mold 100.

Prior to placing concrete into the mold, bolt 80 is used to secure base anchor 98 to insert 102 via a bore 108 formed in the insert. After the concrete sets, bolt 81 is removed leaving base anchor 98 cast therein as shown in FIGS. 7 and 8.

The concrete used in casting the panels in both embodiments of the invention has a relatively low water-to-cement ratio, the present embodiment having a 0.28 ratio of water to cement. This both reduces the conductivity of the concrete and strengthens it. Thus the likelihood of signalization problems, i.e., shorting between rails, is reduced and the resistance to wear from road traffic is increased, which is also aided by chamfers, like chamfer 42 cast into the upper surfaces of either perimeter of each panel.

Bottom surface 104 has a diamond plate finish cast therein to produce the finish on the top surface of the panels shown in FIGS. 1 and 6.

Although not shown in the drawings, it is preferred to include a bevel between each exposed endmost surface on the panels at each end of the crossing and the adjoining top surface. Such a bevel would be formed on the right end of panels 14, 18, 22 in FIG. 6 and on the left end of panels 12, 16, 20, also in FIG. 6. The bevel is preferably at a 45 degree angle and 4 to 6 inches across, depending on the depth of the panel on which it is formed. As trains approach the crossing, hoses, lines, etc., which may hang down below the level of the tracks, strike the beveled surface, and slide up to the top surface of the panel. In the absence of a such a beveled surface, the hanging object would impact the endmost vertical surface of the panel and potentially damage both the object on the train and the panel.

In installing the embodiment of FIGS. 1–5A, the wide panels, like panels 16, 18 are laid end to end at the location of the crossing with enough panels being so positioned to produce a crossing of the desired length. The narrow or field panels, like panels 12, 14 on one side of the track and panels 20, 22 on the other side, are each positioned on the ties as shown opposite a corresponding central panel.

Thereafter, timber screws (not shown) are inserted through the bores, like bores 30, 32, 36 cast into the panels, and screwed into the tie beneath the bore. Thereafter, elastomeric filler, like filler 54, 56 in FIG. 2A, may be positioned on either side of each rail to complete the installation.

In the embodiment of FIGS. 6–8, the panels are positioned as described above and thereafter straps, like strap 76, are positioned within the adjoining recesses on adjacent panel ends, like strap 76 is positioned in recesses 82, 84 on panels 20, 22 in FIG. 7. Thereafter the strap is bolted to each end panel as shown thereby integrating the panels between the rails into a single unit which is substantially resistant to movement due to its size and mass. Each of the adjacent panels on the each field side of the rails are similarly strapped together as shown in FIG. 6. A crossing of any length can be fabricated by laying additional panels end-to-end for either of the disclosed embodiments of the crossing of the invention.

It can thus be seen that the present invention provides a precast concrete grade crossing on a roadway which is durable as a result of the dense concrete and chamfered upper perimeters of each panel. The embodiment of FIG. 6 provides for easy removal and replacement of the panels to service the rail bed without damaging the ties or the structure of the panels. The dense concrete also resists infiltration by salt which can creep into the voids in the concrete and eventually rust the reinforcing steel, thereby causing it to expand and break up the concrete. The potential for setting up a conductive path between the rails is also reduced due to the increased concrete density; separated metal layers of reinforcing steel, like layers 58, 60, 62 in FIG. 5; and lack of metal about the exterior perimeter of the panels.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

We claim:

1. A grade crossing on a roadway intersected by a pair of railroad tracks supported on ties, said grade crossing comprising:

a pair of precast concrete panels laid end to end between such rails on such ties, each of said panels including a recess cast into an upper surface thereof; and a strap substantially coated with a substantially nonconductive elastomer having a first end secured to one of said panels and a second end secured to the other of said panels, said strap being substantially received within said recesses.

2. The grade crossing of claim 1 wherein each of said panels include a threaded bore communicating with a surface of said recess and wherein said strap is secured to said panels with bolts threaded into said bores.

3. The grade crossing of claim 1 wherein said panels each include an endmost surface consisting of a substantially planar concrete surface which extends substantially betweens said tracks when said panels are laid end to end on said ties.

4. The grade crossing of claim 3 wherein said endmost surfaces abut one another when said panels are so laid between said tracks.

5. The grade crossing of claim 1 wherein said grade crossing further includes:

third and fourth precast concrete panels laid end to end on one field side of the tracks, said third and fourth precast concrete panels being supported on said ties;

fifth and sixth precast concrete panels laid end to end on the other field side of the tracks, said fifth and sixth precast concrete panels being supported on said ties;

a second strap having a first end secured to said third panel and a second end secured to said fourth panel; and a third strap having a first end secured to said fifth panel and a second end secured to said sixth panel.

6. A panel assembly for use in a grade crossing on a roadway intersected by a pair of railroad tracks supported on ties, said panel assembly comprising:

a precast concrete panel having an upper surface adapted to be substantially planar with the upper surface of such tracks when said panel is supported on such ties between such tracks;

a recess formed in said upper surface and communicating with said upper surface and with an end surface of said panel which extends substantially between such tracks when such panel is supported on such ties between such tracks;

a threaded bore communicating with said upper surface and received in said recess: and a strap having at least one hole formed therethrough and a first end sized to be substantially received in said recess of said panel when said panel is positioned on such ties, said bore being substantially aligned with said at lest one strap hole when said strap is so received.

7. The panel assembly of claim 6 wherein said panel assembly further includes:

a second precast concrete panel having an upper surface adapted to be substantially planar with the upper surface of such tracks when said second panel is supported on such ties between such tracks;

a recess formed in said second panel upper surface and communicating with said second panel upper surface and with an end surface of said second panel which extends between such tracks when said second panel is supported on such ties between such tracks;

a threaded bore communicating with said second panel upper surface and received in said recess of said second panel; and said strap further having a pair of said strap holes formed therethrough and a second end sized to be substantially received in the recess of said second panel when said panels are positioned end to end on such ties, said first and second bores being substantially aligned with said strap holes when said strap is so received.

8. A method of making a grade crossing on a roadway intersected by a pair of railroad tracks supported on ties, said method comprising the steps of:

placing wet concrete into a substantially rectangular mold having substantially upright sides and ends and a bottom surface thereby forming a substantially rectangular panel having a top surface formed against the bottom surface of the mold and an opposed panel bottom surface;

so forming a plurality of such panels;

laying a pair of said panels end to end with the panel bottom surfaces on such ties; and using a strap to secure each of said panels together; and coating said strap with a substantially nonconductive elastomer.

9. The method of claim 8 wherein said panel includes endmost and sidemost surfaces molded directly against the ends and sides of said mold and wherein said panel surfaces consist of substantially planar concrete surfaces.

10. The method of claim 9 wherein the step of laying a pair of said panels end to end with the panel bottom surfaces on said ties comprises the step of abutting the endmost surfaces of said panels against one another.

11. The method of claim 10 wherein said panels include a plurality of bores communicating between said top and bottom surfaces of said panels for bolting said panels to said ties.

12. The method of claim 8 wherein said method further includes the step of placing an insert in said mold adjacent each end thereof for creating recesses in each panel end.

13. The method of claim 12 wherein said method further includes the step of forming a threaded bore in each panel end which communicates with each panel recess.

14. The method of claim 13 wherein said method further includes the steps of:

substantially aligning the recesses in said pair of panels when they are laid end to end;

inserting a strap into the recesses; and using the threaded bores to bolt the strap to each panel.

15. A method of making a grade crossing on a roadway intersected by a pair of railroad tracks supported on ties, said method comprising the steps of:

placing wet concrete into a substantially rectangular mold having substantially upright sides and ends and a bottom surface thereby forming a substantially rectangular panel having a top surface formed against the bottom surface of said mold and an opposed panel bottom surface;

so forming a plurality of such panels;

laying a pair of said panels end to end with the panel bottom surfaces on said ties;

placing an insert in said mold adjacent each end thereof for creating recesses in each panel end; and forming a threaded bore in each panel end which communicates with each panel recess.

16. The method of claim 15 wherein said panel includes endmost and sidemost surfaces molded directly against the ends and sides of said mold and wherein said panel surfaces consist of substantially planar concrete surfaces.

17. The method of claim 16 wherein the step of laying a pair of said panels end to end with the panel bottom surfaces on said ties comprises the step of abutting the endmost surfaces of said panels against one another.

18. The method of claim 17 wherein said panels include a plurality of bores communicating between said top and bottom surfaces of said panels for bolting said panels to said ties.

19. The method of claim 15 wherein said method further includes the steps of:

substantially aligning the recesses in said pair of panels when they are laid end to end;

inserting a strap into the recesses; and using the threaded bores to bolt the strap to each panel.

20. A panel assembly for use in a grade crossing on a roadway intersected by a pair of railroad tracks supported on ties, said panel assembly comprising:

a precast concrete panel having an upper surface adapted to be substantially planar with the upper surface of such tracks when said panel is supported on such ties between such tracks;

a recess formed in said upper surface and communicating with said upper surface and with an end surface of said panel which extends substantially between such tracks when said panel is supported on such ties between such tracks;

a threaded bore communicating with said upper surface and received in said recess;

a second precast concrete panel having an upper surface adapted to be substantially planar with the upper surface of such tracks when said panel is supported on such ties between such tracks;

a recess formed in said second panel upper surface and communicating with said second panel upper surface and with an end surface of said second panel which extends between such tracks when said second panel is supported on such ties between such tracks;

a threaded bore communicating with said second panel upper surface and received in said recess; and a steel strap having a pair of holes formed therethrough, said strap being sized to be substantially received in the recesses of said first and second panels when said panels are positioned end to end on such ties, said bores being substantially aligned with said strap holes when said strap is so received.

* * * * *